US009431735B2

(12) United States Patent
Yu et al.

(10) Patent No.: US 9,431,735 B2
(45) Date of Patent: Aug. 30, 2016

(54) PLUG CONNECTOR, RECEPTACLE CONNECTOR AND ELECTRICAL CONNECTOR ASSEMBLY

(71) Applicant: ALLTOP ELECTRONICS (SUZHOU) LTD., Taicang, JiangSu Province (CN)

(72) Inventors: Wang-I Yu, Jhonghe (TW); Yong-Gang Zhang, Jhonghe (TW); Shuang-Feng Li, Jhonghe (TW); Yu-Hui Zhang, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 14/481,036

(22) Filed: Sep. 9, 2014

(65) Prior Publication Data

US 2015/0364845 A1 Dec. 17, 2015

(30) Foreign Application Priority Data

Jun. 12, 2014 (CN) ..... 2014 1 0258651

(51) Int. Cl.
*H01R 13/631* (2006.01)
*H01R 12/72* (2011.01)
*H01R 13/52* (2006.01)

(52) U.S. Cl.
CPC ..... *H01R 12/724* (2013.01); *H01R 13/521* (2013.01)

(58) Field of Classification Search
CPC ..... H01R 13/631; H01R 13/629; H01R 23/7073; H01R 13/5219; H01R 13/5202; H01R 4/2404
See application file for complete search history.

(56) References Cited

U.S. PATENT DOCUMENTS

| | | | | | |
|---|---|---|---|---|---|
| 3,264,599 | A * | 8/1966 | Kinkaid | H01R 12/724 | 439/374 |
| 3,966,290 | A * | 6/1976 | Little | H01R 12/727 | 439/374 |
| 4,260,966 | A * | 4/1981 | Boutros | H01R 13/7197 | 333/182 |
| 5,030,130 | A * | 7/1991 | Natsume | H01R 13/629 | 439/374 |
| 5,129,831 | A * | 7/1992 | Locati | H01R 12/712 | 439/374 |
| 5,486,118 | A * | 1/1996 | Colleran | H01R 13/436 | 439/374 |
| 5,595,496 | A * | 1/1997 | Konda | H01R 13/5219 | 439/271 |
| 5,637,019 | A * | 6/1997 | Crane, Jr. | H01R 13/64 | 439/374 |
| 6,361,341 | B1 * | 3/2002 | Okayasu | H01R 13/5216 | 439/271 |
| 6,361,350 | B2 * | 3/2002 | Johnson | | 439/374 |
| 6,848,925 | B2 * | 2/2005 | Nishide | H01R 13/73 | 439/157 |
| 8,038,466 | B1 * | 10/2011 | Tai | H01R 12/7082 | 439/206 |
| 8,702,445 | B2 * | 4/2014 | Yu | H01R 13/46 | 439/485 |
| 8,926,117 | B2 * | 1/2015 | Blanchette | F21L 4/02 | 15/106 |

(Continued)

*Primary Examiner* — Gary Paumen
(74) *Attorney, Agent, or Firm* — Sughrue Mion, PLLC

(57) ABSTRACT

A connector assembly includes a plug connector and a receptacle. The plug connector includes a plug housing and a number of plug contacts retained in the plug housing. The plug housing has a mating portion with a mating surface. The receptacle connector includes a receptacle housing and a plurality of receptacle contacts retained in the receptacle housing. The receptacle housing defines a receiving space opening forwardly and a jointing surface at an inner side of the receiving space. Besides, the connector assembly further includes a waterproof plate sandwiched between the mating surface and the jointing surface as the plug connector mating with the receptacle connector.

13 Claims, 11 Drawing Sheets

(56) References Cited

U.S. PATENT DOCUMENTS

2005/0037651 A1* 2/2005 Axenbock ..... H01R 13/2421 439/271
2010/0178787 A1* 7/2010 Lux ..... H01R 13/4534 439/271
2011/0287658 A1* 11/2011 Yu ..... H01R 12/7088 439/485
2013/0260593 A1* 10/2013 Tai ..... H01R 13/50 439/345
2014/0170878 A1* 6/2014 Jocham ..... H01R 13/4361 439/271

* cited by examiner

PLUG CONNECTOR, RECEPTACLE CONNECTOR AND ELECTRICAL CONNECTOR ASSEMBLY

BACKGROUND

1. Technical Field

The present disclosure relates to a plug connector, a receptacle connector and an electrical connector assembly, and more particularly to a plug connector and a receptacle connector being mated together and to an electrical connector assembly having improved components, being capable of providing a stable hold.

2. Description of Related Art

At present, a connector mainly includes a housing and a plurality of terminals. The connector is mounted on a circuit board for being mated with a complementary connector. By the terminals of the two connectors contacting with each other, the two connectors form an electrical transmission therebetween. Sometimes, the connector is assembled with a hollow waterproof ring ringing at outside of the mating position thereof. The hollow waterproof ring is provided to prevent water from being flow into the circuit board. However, when the two connectors do not contact with each other stably, the waterproof ring cannot be in effect valid effective.

It is desirable to provide an improved plug connector, receptacle connector and electrical connector assembly for solving above problems.

SUMMARY

In one aspect, the present invention includes a plug connector for mating with a receptacle connector. The plug connector comprises a plug housing and a plurality of plug contacts retained in the plug housing. The plug housing has a mating portion with a mating surface. The mating portion is formed with a ring-like projection forwardly protruding from the mating surface, and the extension length of the ring-like projection is different from top to bottom.

In another aspect of the present invention, a receptacle connector for mating with a plug connector, comprises a receptacle housing and a plurality of receptacle contacts retained in the receptacle housing. The receptacle housing defines a receiving space opening forwardly and a jointing surface at an inner side of the receiving space. Besides, the receptacle connector further includes a waterproof plate received in the receiving space and keeping close to the joint surface.

In a third aspect of the present invention, a connector assembly includes a plug connector and a receptacle. The plug connector includes a plug housing and a number of plug contacts retained in the plug housing. The plug housing has a mating portion with a mating surface. The receptacle connector includes a receptacle housing and a plurality of receptacle contacts retained in the receptacle housing. The receptacle housing defines a receiving space opening forwardly and a jointing surface at an inner side of the receiving space. Besides, the connector assembly further includes a waterproof plate sandwiched between the mating surface and the jointing surface as the plug connector mating with the receptacle connector.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
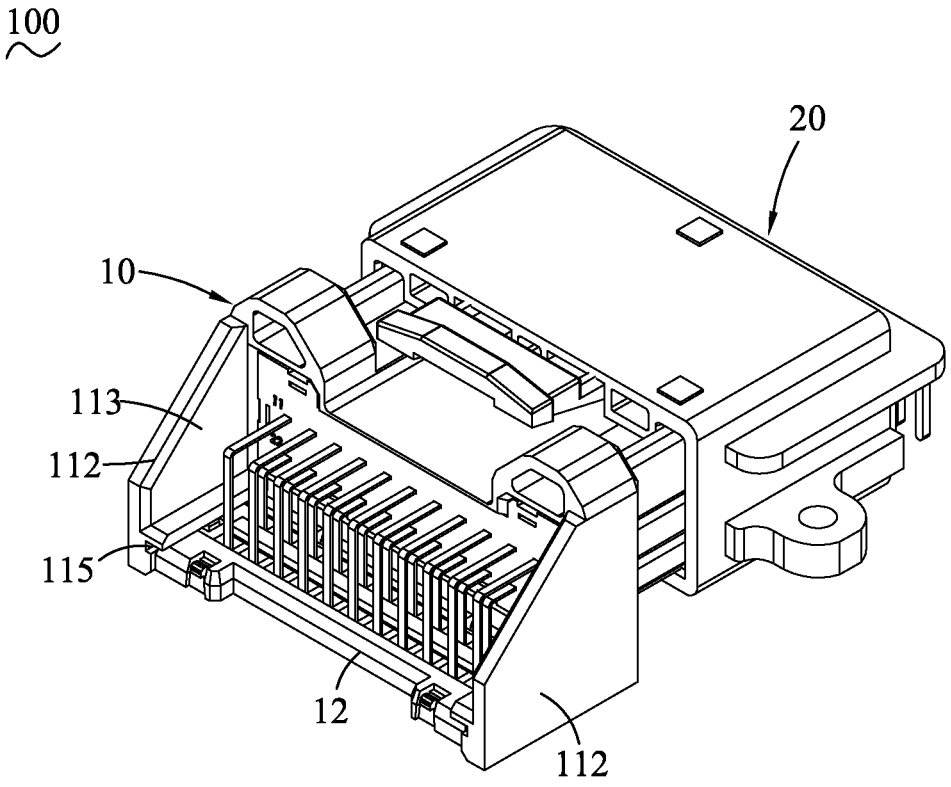
FIG. 1 is a perspective view of a connector assembly in accordance with an illustrated embodiment of the present disclosure.
Figure 2:
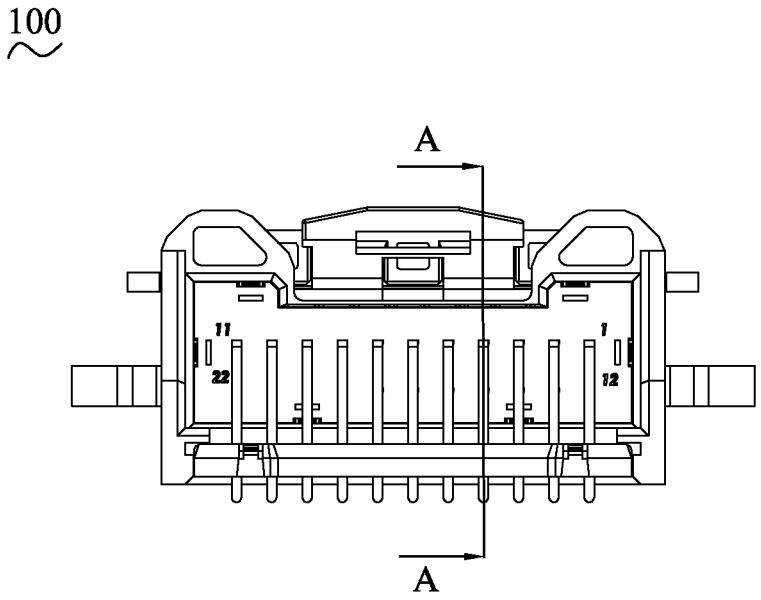
FIG. 2 is a back view of the connector assembly as shown in FIG. 1.

Reference will now be made to the drawing figures to describe the embodiments of the present disclosure in detail. In the following description, the same drawing reference numerals are used for the same elements in different drawings.

Referring to FIGS. 1 to 7, an illustrated embodiment of the present disclosure discloses a connector assembly 100 comprises a plug connector 10 and a receptacle connector 20 mating with each other, and a waterproof plate 30 retained in the receptacle connector 20.

Figure 4:
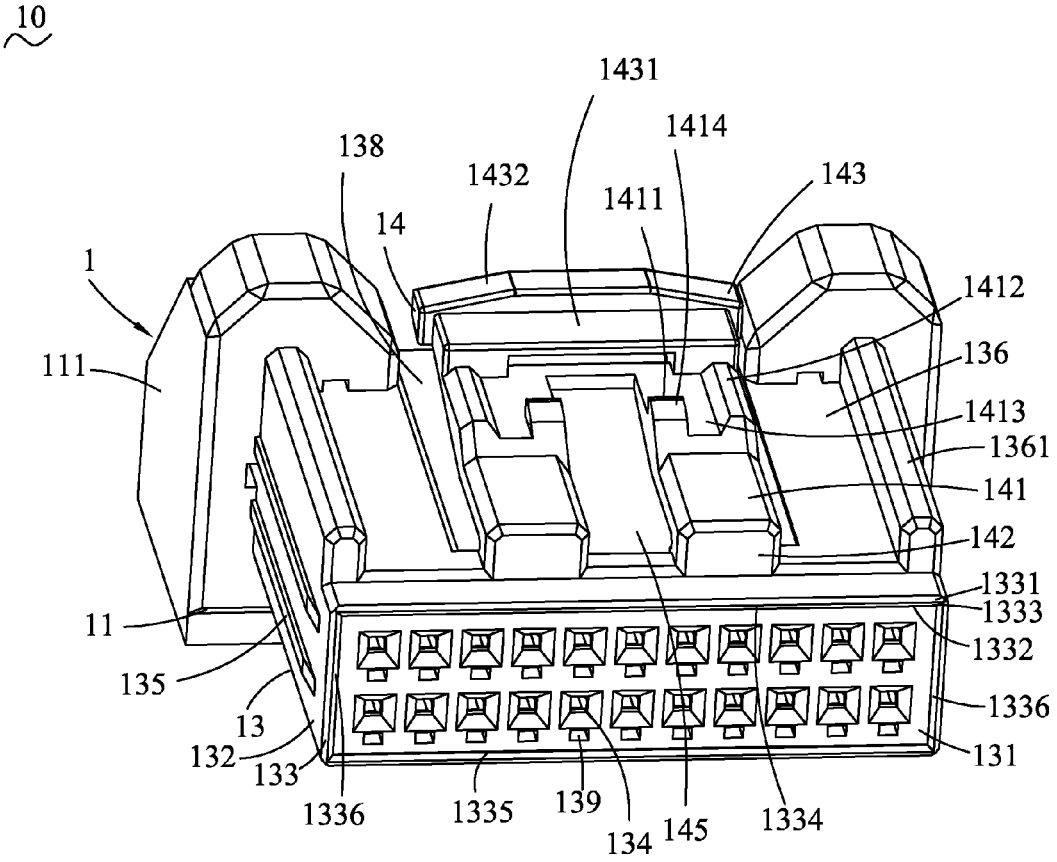
FIG. 4 is a perspective view of a plug connector of the connector assembly shown in FIG. 1.
Figure 5:
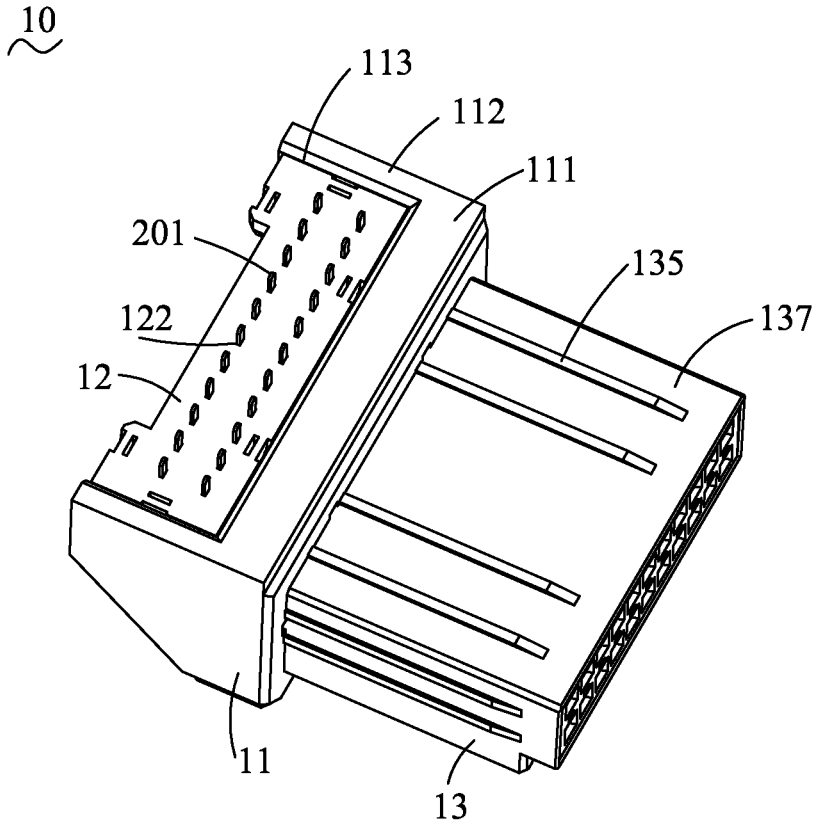
FIG. 5 is a similar to FIG. 4, but viewed from another aspect.

Referring to FIGS. 1, 4 and 5, the plug connector 10 comprises a plug housing 1 and a plurality of plug contacts 201 retained in the plug housing 1. The plug housing 1 has a body 11, a plug spacer 12 attached to the plug housing 1, a mating portion 13 forwardly extending from the body 11 and a latch 14 formed on an upper side of the mating portion 13.

The body 11 has a main portion 111, a pair of side walls 112 backwardly extending from two sides of the main portion 111, and a retaining room 113 formed between the main portion 111 and the side walls 112. The plug spacer 12 is assembled in a lower side of the retaining room 113, and defines a plurality of holes 122 to position the plug contacts 201. The side walls 112 define a pair of elongated slots 115 to receive and retain two sides of the plug spacer 12.

The mating portion 13 has a mating surface 131 toward the receptacle connector 20, a ring-like projection 133 forwardly protruding from edges of the mating surface 131, a pair of side surfaces 132, an upper surface 136, a lower surface 137, a plurality of blocks 135 outwardly extending from the side surfaces 132 and lower surface 137, and a pair of guiding ribs 1361 upwardly from two sides of the upper surface 136. The guiding ribs 1361 extend along a front to back direction.

The extension length of the ring-like projection 133 is different from top to bottom, and concretely, in the present embodiment, The extension length of the ring-like projection 133 is increased from top to bottom, which can balance out stress between the plug connector 10 and the receptacle connector 20 when they are mated with each other, and provide a stable connection between the plug connector 10 and the receptacle connector 20. The ring-like projection 133 has front end surface 1331, inner surface 1332 and transitional inclined surface 1333 connecting the front end surface 1331 and the inner surface 1332. The inclined surface 1333 has an upper portion 1334 and a lower portion 1335 facing to each other, and a middle portion 1336 connecting two sides of the upper portion 1334 and the lower portions 1335. The angle between the upper portion 1334 and the inner surface 1332 is different from that between the lower portion 1335 and the inner surface 1332, and concretely, in the present embodiment, the angle between the upper portion 1334 and the inner surface 1332 is larger than that between the lower portion 1335 and the inner surface 1332.

Besides, the mating portion 13 defines a plurality of contact slots 134 extending along the front to back direction, and a number of heat dissipation holes 139 corresponding to the contact slots 134. The heat dissipation holes 139 extend through the mating surface 131 and communicate with the contact slots 134.

The latch 14 is located between the guiding ribs 1361, and has a pair of spring arms 141 located above the upper surface 136, a pair of connection portions 142 connecting front ends of the spring arms 141 and the upper surface 136, and a cantilever 143 connecting rear ends of the pair of spring arms 141. The spring arms 141 parallel to each other, and space apart to the upper surface 136 along an up to down direction. The floating space between the spring arm 141 and the upper surface 136 is increased from front to back. The upper surface 136 defines a depression 138 under the spring arms 141 to increase the floating space to the spring arms 141. The spring arms 141 define a space 145 therebetween. Each spring arm 141 is formed with a limiting block 1412 at top thereof, a locking protrusion 1411 at internal of the limiting block 1412, and a gap 1413 between the limiting block 1412 and the locking protrusion 1411. The limiting block 1412 extends along the front to back direction. The locking protrusion 1411 has an inclined guiding surface 1414 at a front side thereof. The cantilever 143 has a first ladder portion 1431 and a second ladder portion 1432. The second ladder portion 1432 is located behind the first ladder portion 1431 and higher than the first ladder portion 1431.

Figure 3:
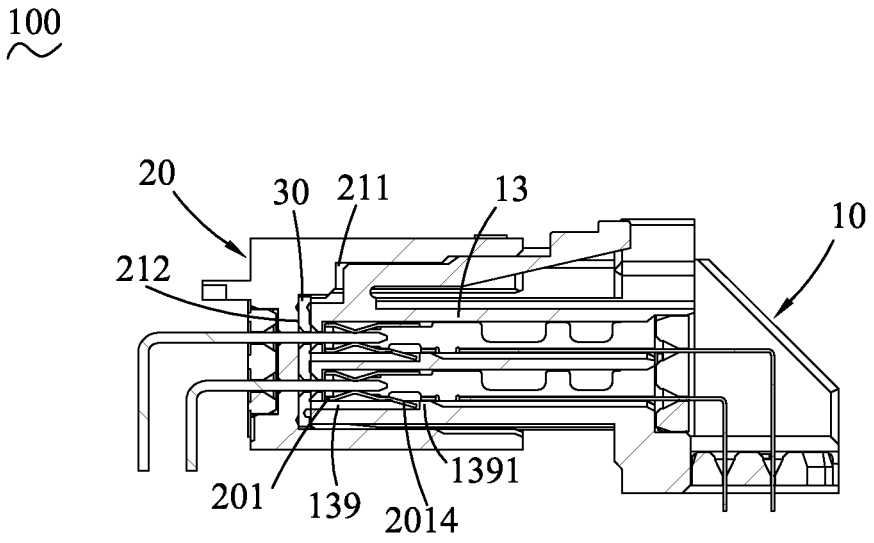
FIG. 3 is a cross-sectional view of the connector assembly taken along line A-A of FIG. 2.
Figure 6:
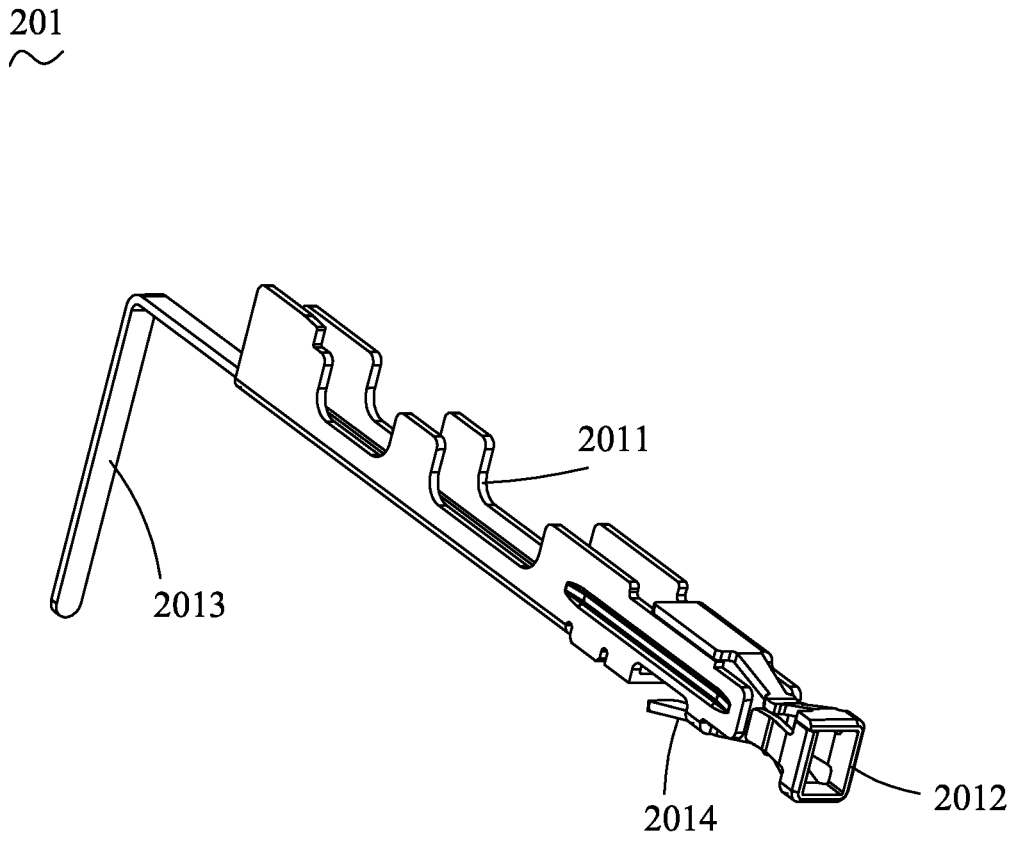
FIG. 6 is a plug contact of the plug connector shown in FIG. 4.
Figure 7:
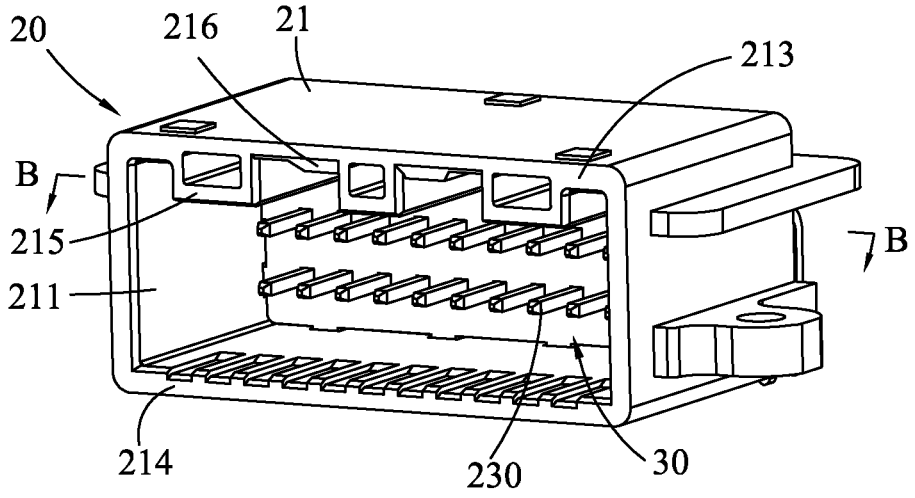
FIG. 7 is a perspective view of a receptacle connector of the connector assembly shown in FIG. 1.
Figure 8:
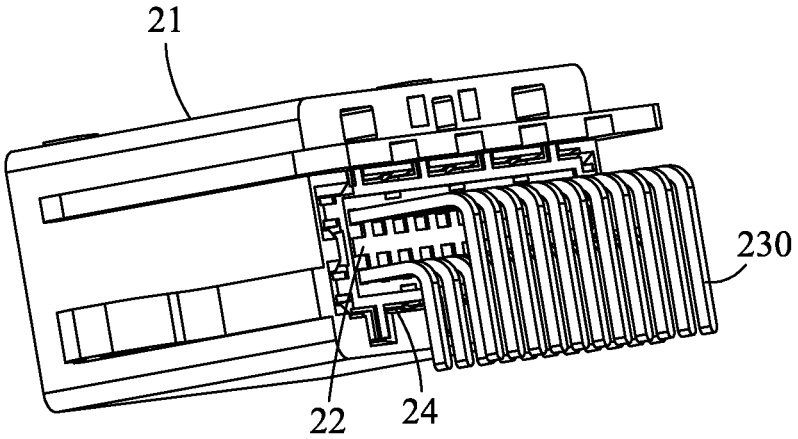
FIG. 8 is a similar to FIG. 7, but viewed from another aspect.

Referring to FIGS. 3, 5 and 6, each plug contact 201 has a first retaining portion 2011, a first contact portion 2012 forwardly extending from a front end of the first retaining portion 2011 and a first soldering portion 2013 extending from a rear end of the first retaining portion 2011. The retaining portion 2011 has a spring tab 2014 backwardly extending from a lower side thereof. Each of the heat dissipation holes 139 is formed with a projection 1391 upwardly extending to abut against a rear end of the spring tab 2014. The first contact portion 2012 is rectangular and exposed in the contact slot 134 to electrically connect with the receptacle connector 20. The first soldering portions 2013 are positioned by the plug spacer 12, which can prevent adjacent first soldering portions 2013 from contacting with each other.

Referring to FIGS. 1, 3, 7 to 10, the receptacle connector 20 comprises a receptacle housing 21, a plurality of receptacle contacts 230 retained in the receptacle housing 21, and a receptacle spacer 22.

The receptacle housing 21 defines a receiving space 211 surrounded by an upper wall 213, a lower wall 214, a pair of side walls (not labeled) and a rear wall 210, three extension blocks 215 downwardly extending from the upper wall 213, and two resisting blocks 216 between adjacent extension blocks 215. The receiving space 211 opens forwardly. The resisting blocks 216 are thinner than the extension blocks 215 along the up to down direction. Each of the resisting blocks 216 defines a locking groove (not labeled) at a lower side thereof. The rear wall 210 has a jointing surface 212 at a rear inner side of the receiving space 211 and exposed to the receiving space 211, and a rear surface 218 opposite to the jointing surface 212. The rear wall 210 defines a plurality of contact holes 219 extending through the jointing surface 212 and the rear surface 218.

When the receptacle connector 20 mates with the plug connector 10, two external extension blocks 215 are received between the spring arms 141 and the guiding ribs 1361, and one internal extension block 215 is received in the space 145 between two spring arms 141, the locking protrusion 1411 locks with the locking groove of the resisting block 216.

The receptacle housing 21 defines a rear cavity 24 at a rear side of the rear wall 210. The receptacle spacer 22 is retained in the rear cavity 24. The receptacle spacer 22 has a platy portion 222 and a plurality of position posts 223 forwardly extending from the platy portion 222. The platy portion 222 defines a number of through holes 221 corresponding to the contact holes 219. The position posts 223 are positioned to the rear wall 210.

Each receptacle contact 230 has a second contact portion 231 received in the receiving space 211, a second retaining portion 232 backwardly extending from a rear end of the second contact portion 231 and a second soldering portion 233 extending from the second retaining portion 232. The second retaining portions 232 extend through the contact holes 219 and the through holes 221, and are retained therein. The second retaining portions 232 are formed with barbs 234 sandwiched between the rear wall 210 and the receptacle spacer 22.

Figure 9:
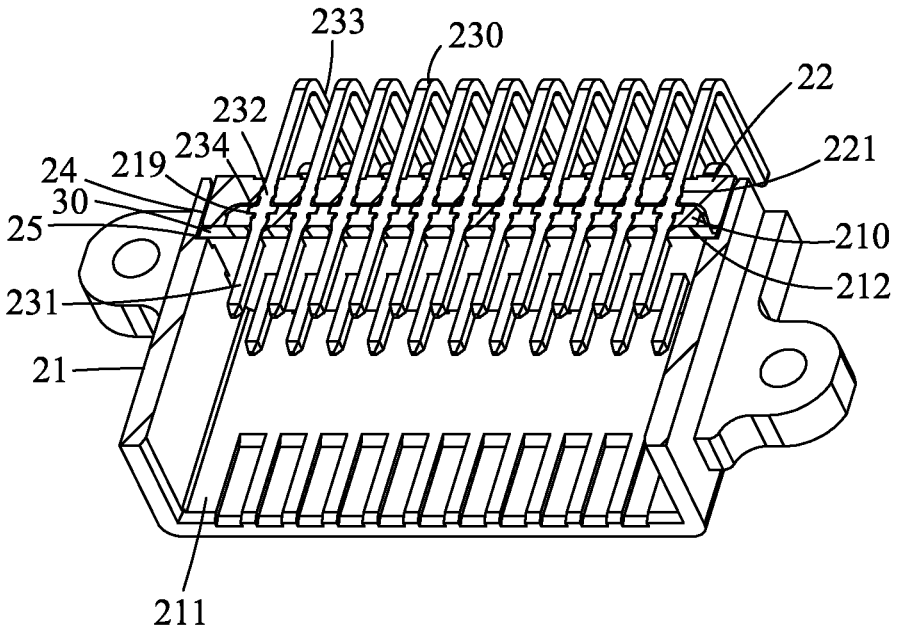
FIG. 9 is a cross-sectional view of the connector assembly taken along line B-B of FIG. 7.
Figure 10:
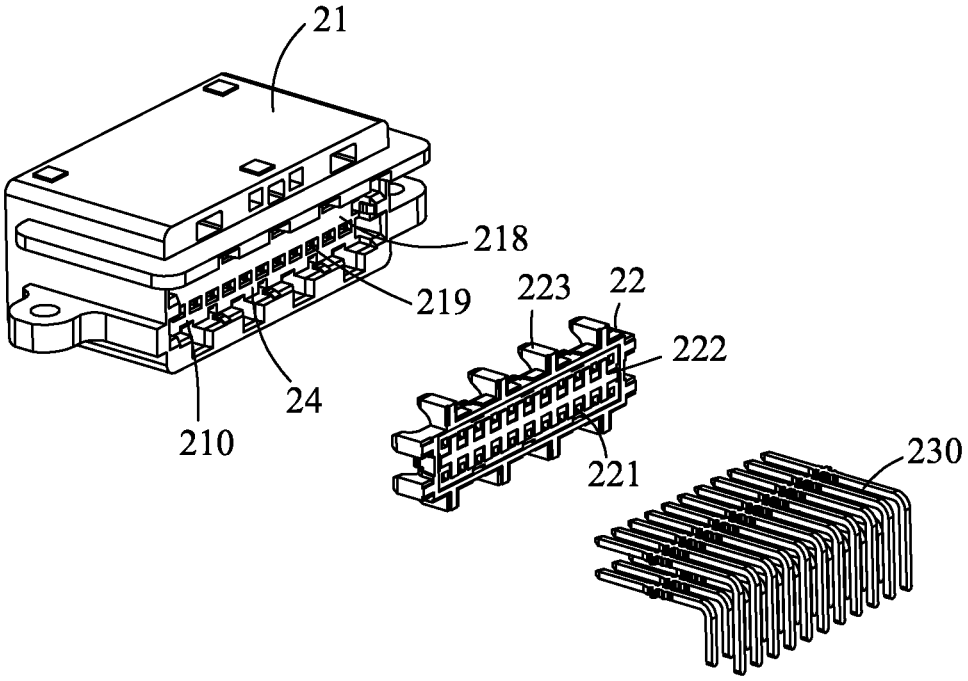
FIG. 10 is a partially exploded view of the receptacle connector shown in FIG. 7.
Figure 11:
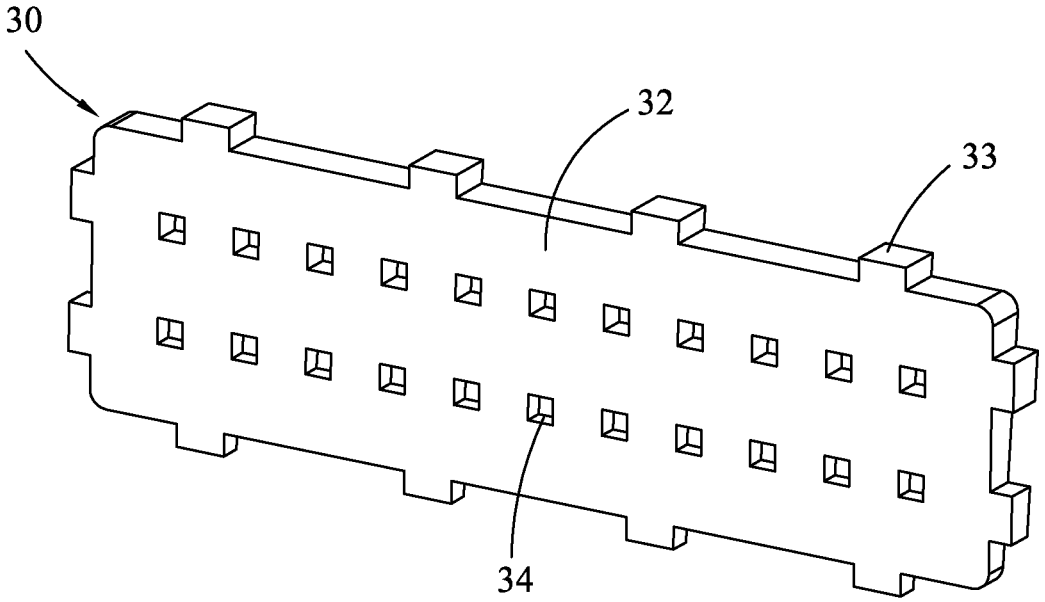
FIG. 11 is a perspective view of a waterproof plate of the receptacle connector shown in FIG. 7.

Referring to FIGS. 9 and 11, the waterproof plate 30 is retained in the receiving space 211 and keep close to the jointing surface 212 in the present embodiment. The waterproof pate 30 is made of elastic material, and has a base 32 and a plurality of protrusions 33 outwardly extending from the base 32. The upper wall 213, lower wall 214 and side walls define a plurality of recesses 25 to engage with the protrusions 33. The base 32 defines a plurality of holes 34 provided for the second contact portions 231 extending there through. When the receptacle connector 20 mates with the plug connector 10, the waterproof plate 30 is sandwiched between the jointing surface 212 and the mating surface 131.

As described above, when the plug connector 10 mates with the receptacle connector 20, the ring-like projection 133 with different extension length from top to bottom or the waterproof plate 30 with different thickness can balance out the stress between the latch 14 and the resisting blocks 216, which can assure the stable connection between the plug connector 10 and the receptacle connector 20. Of course, in an alternative embodiment, either the ring-like projection 133 with different extension length from top to bottom or the waterproof plate 30 with different thickness is selected to be provided on the plug connector 10 or the receptacle connector 20 only, which also can be achieve above effect.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A receptacle connector for mating with a plug connector, comprising:

a receptacle housing defining a receiving space opening forwardly and a jointing surface at an inner side of the receiving space;

a plurality of receptacle contacts retained in the receptacle housing;

a waterproof plate received in the receiving space and kept close to the joint surface;

wherein the thickness of the waterproof plate is decreased from top to bottom.

2. The receptacle connector as claimed in claim 1, wherein the waterproof plate is made of elastic material.

3. The receptacle connector as claimed in claim 1, wherein each receptacle contact has a contact portion extending to the receiving space, and the waterproof plate defines a plurality of holes provided for the contact portions extending there through.

4. The receptacle connector as claimed in claim 1, wherein the waterproof plate has a base and a plurality of protrusions outwardly extending from the base, and the receptacle housing defines a plurality of recesses to engage with the protrusions.

5. A connector assembly, comprising:

a plug connector having a plug housing and a plurality of plug contacts retained in the plug housing, the plug housing having a mating portion with a mating surface;

a receptacle connector having a receptacle housing and a plurality of receptacle contacts retained in the receptacle housing, the receptacle housing defining a receiving space opening forwardly and a jointing surface at an inner side of the receiving space;

a waterproof plate sandwiched between the mating surface and the jointing surface as the plug connector mating with the receptacle connector;

wherein the thickness of the waterproof plate is decreased from top to bottom.

6. The connector assembly as claimed in claim 5, wherein the waterproof plate is made of elastic material.

7. The connector assembly as claimed in claim 5, wherein the waterproof plate is received in the receiving space and kept close to the joint surface.

8. The connector assembly as claimed in claim 5, wherein each receptacle contact has a contact portion extending to the receiving space, and the waterproof plate defines a plurality of holes provided for the contact portions extending there through.

9. The connector assembly as claimed in claim 5, wherein the mating portion is formed with a ring-like projection forwardly protruding from the mating surface, and the extension length of the ring-like projection is different from top to bottom.

10. The connector assembly as claimed in claim 9, wherein the extension length of the ring-like projection is increased from top to bottom.

11. The connector assembly as claimed in claim 5, wherein the mating portion defines a plurality of contact slots and a plurality of heat dissipation holes corresponding to the contact slots, and the heat dissipation holes communicate with the contact slots.

12. The connector assembly as claimed in claim 11, wherein the heat dissipation holes extend through the mating surface.

13. The connector assembly as claimed in claim 11, wherein each plug contact has a first retaining portion retained in the contact slots, a first contact portion forwardly extending from a front end of the first retaining portion and a first soldering portion extending from a rear end of the first retaining portion, the retaining portion having a spring tab backwardly extending from a lower side thereof, the heat dissipation hole being formed with a projection upwardly extending to abut against a rear end of the spring tab.

* * * * *